US005564210A

United States Patent [19]

Hetzer et al.

[11] Patent Number: 5,564,210

[45] Date of Patent: Oct. 15, 1996

[54] PRICE CASSETTE

[75] Inventors: Norbert Hetzer, Lobbach, Germany; Antonio Chamorro Barrera, Rubi, Spain

[73] Assignee: Esselte Meto International GmbH, Heppenheim, Germany

[21] Appl. No.: 387,713

[22] PCT Filed: Jul. 19, 1994

[86] PCT No.: PCT/EP94/02364

§ 371 Date: Mar. 30, 1995

§ 102(e) Date: Mar. 30, 1995

[87] PCT Pub. No.: WO95/04984

PCT Pub. Date: Feb. 16, 1995

[30] Foreign Application Priority Data

Aug. 4, 1993 [DE] Germany ..... 43 26 172.8

[51] Int. Cl.[6] ..... G09F 3/20

[52] U.S. Cl. ..... 40/649; 40/5

[58] Field of Search ..... 40/5, 490, 618, 40/642, 649; 116/321, 323, 324

[56] References Cited

U.S. PATENT DOCUMENTS

| | | | |
|---|---|---|---|
| 4,682,430 | 7/1987 | Ramsay | 40/649 X |
| 5,214,871 | 6/1993 | DiCataldo, Sr. | 40/649 |

FOREIGN PATENT DOCUMENTS

| | | | |
|---|---|---|---|
| 0152398 | 8/1985 | European Pat. Off. . | |
| 383042 | 8/1990 | European Pat. Off. | 40/490 |
| 0452296 | 10/1991 | European Pat. Off. . | |
| 452296 | 10/1991 | European Pat. Off. | 40/5 |
| 8104071 | 10/1981 | Germany . | |
| 8403571 | 5/1984 | Germany . | |
| 8533519 | 2/1986 | Germany . | |
| 2096377 | 10/1982 | United Kingdom . | |

*Primary Examiner*—Brian K. Green
*Attorney, Agent, or Firm*—Nils H. Ljungman and Associates

[57] ABSTRACT

A price cassette with a back part which has panes to hold interchangeable item identification and/or price labels which are separated by vertical webs, whereby on the back part there are vertical guides, over which the at least partly transparent front part can be slid. The price cassette is thereby curved around an imaginary axis which is horizontal to the item identification and price signs, and the axis of which lies behind the price cassette. The item identification and price information displayed thereby appears more plastic and elegant. The only action required to change this item identification and price information is to open the price cassette partway up or down. The item identification and price signs thereby remain fixed in place.

21 Claims, 3 Drawing Sheets

PRICE CASSETTE

BACKGROUND OF THE INVENTION

1. Field of the Invention:

This invention relates to a price cassette with a bottom part which has panes separated by vertical webs to hold interchangeable merchandise identification or price signs, whereby there are guides on the bottom part, over which a transparent top part can be at least partly inserted.

2. Background Information:

Such a price cassette is disclosed by German Utility Model 81 04 071.

On the price cassette of the prior art, the front part is slipped over the back part laterally. In the panes, there are accordion-fold strips with price numbers or item identifications, such as weight, product categories etc. On each folded section of a strip there are two markings which are upside down in relation to one another. The strips are inserted into the panes so that the desired marking is in the lower portion of the panes. Running crosswise above all the panes of the upper portion, there is a sign with a printed product name and additional information as necessary. Between these signs and the slipped-on front part, there is also an aperture plate which provides a color frame for the information to be presented, and covers the webs or other parts inside the back part which should remain invisible. The aperture plate can thereby be installed permanently in the front part, and can be slid on and off with the latter, or it can be inserted loosely in the back part, to prevent the strip and the item identification sign from falling out when the front part is being slid on.

This embodiment of a price cassette of the prior art is quite difficult to handle. Even if only minor changes have to be made, e.g. if the last digit of a price sign must be corrected, the price cassette must be opened completely. The accordion-fold strips then spring forward and the entire contents can escape from the price cassette. Of course, this effect is desirable when the price cassette is closed, so that all the signs will be in clean contact with the transparent top part, but when the price cassette is open, it takes a good deal of dexterity on the part of the operator to keep all the parts under control. It frequently happens that the coiled strips and the item identification signs shift out of position when the cassette is closed, and thus are at least significantly off-center in the panes. On price cassettes of the prior art, jamming also occurs frequently.

OBJECT OF THE INVENTION

The object of the invention is to improve a price cassette of the type described above so that the price cassette need only be opened part way to change individual signs, and so that all the information media inserted remain fixed in place, and so that the strips inserted do not shift over the webs when the price cassette is closed.

SUMMARY OF THE INVENTION

The invention teaches that this object can be accomplished if the guides run parallel to the webs, so that the top part can be slid on and off upward and/or downward. As a result of this configuration, the front part can always be displaced so that only a portion of the upper or lower half of the back part is exposed. If the front part is pushed upward, all the panes are accessible between the webs at the base. The strips inserted in the panes can be grasped from the bottom, pulled out and reinserted under the front part and the item sign located in the upper half. The strips can thereby be loosely clamped in place, so that they will not slide out, or they can be held by a stop on the base of the respective pane. During the subsequent closing of the front part, the strips are introduced into the panes in the vertical direction, parallel to the webs, from the lower edge of the top part. The webs can thereby not be displaced, and the price cassette will not jam. In the same manner, the operator can gain access to the item identification sign merely by pushing the top part down slightly.

Since these price cassettes are conventionally attached to the front edges of store shelves, there is an additional and elementary advantage when several price cassettes are fastened immediately next to one another, which is that each of these price cassettes can be opened independently, without disturbing the adjacent price cassettes. It is not necessary to leave an open space between the price cassettes as a function of their width, or to remove the price cassettes from the shelves before opening them.

In one embodiment of the invention, there is at least one stop in the back part and/or in the front part, which stop prevents the front part from being slid off completely. Thus there is a certainty that the front part cannot accidentally be completely pushed off. In an embodiment, it is thereby appropriate to locate the stop on the back part, so that the front part can only be pushed halfway up and down from the back part. In one structurally simple configuration, as a stop on the back part, the webs have raised portions in the vicinity of the middle of the price cassette, each of which interacts with a step formed on the upper and lower edge of the front part facing the back part. The raised portions on the webs should thereby have a side which projects perpendicularly from the back part, while the steps on the front part are inclined. The stops designed as raised areas on the webs can thereby simultaneously act as stops for the item identification sign which is be inserted from above. Therefore, this sign can no longer slide down, and is held straight by the stops on the webs. On account of the inclined design of the steps on the reverse side of the top add bottom edges of the front part, the strips and the item identification signs can no longer get caught behind this stop. When these reverse steps, seen on a connecting line running between the guides, are located only in the middle portion of the front part, by means of interaction with the top and bottom edges of the back part, the price cassette can be locked in the closed position. This lock can then be released, when the interacting parts are correctly sized, by applying a slight force and elastic deformation to the front and back parts to open the price cassette. But at least one flexible tab can also be formed on the back part, which is engaged in a recess in the front part.

In one embodiment of the price cassette, in the upper half of the front part there is a partition, between which the top half of the price signs located between the webs can be inserted. The panes in the top half of the back part are thereby designed as a closed space into which the strips are inserted, while the item identification sign is in contact with the outside of this partition. So that it will also remain fixed in place when the price cassette is open, a mounting element is located on the partition, which fixes the item identification sign in place by means of its bottom edge. This mounting element can be designed very simply as a slot in the partition.

The price cassette has a particularly pleasing appearance if the front part is curved in a circular fashion around an imaginary axis which is horizontal to the identification and/or price signs and lies behind the price cassette. The price cassettes then act directly to round off the edges of the shelves to which they are fastened. The price and item information presented has a more plastic and elegant appearance. Then, if the back part is also curved to correspond to the curvature of the top part, the strips and the item sign inserted are pressed forward as a function of the curvature and are always in flush contact against the inside of the front part, so that there are no interruptions in the appearance of the display surface. As an aperture plate, a cover film which is transparent in the vicinity of the windows can then be inserted on the reverse side of the front part, and can be prestressed between stops so that it corresponds to the curvature of the front part. Thus this aperture plate is also always in flush contact against the inside of the front part, and can be fixed in an extremely simple manner without the requirement for any additional elements. But is still easy to change. The entire appearance of the price displays in a market can be changed significantly, to meet special requirements and wishes, merely by changing the aperture plates on all the price cassettes.

There can be direct mounting elements on the reverse side of the back part for fastening the price cassettes to the shelf edges. Since many shelves are already equipped with C-shaped mounting rails, it is appropriate if the mounting elements are designed as mounting webs which project in the reverse plane of the lower part from its top and bottom edges. There can be additional mounting elements between the mounting webs so that the price cassette can also be used on other, existing fastening systems without requiring any additional modifications. As a result of the curvature of the price cassette, such mounting elements are practically flush between the mounting webs. The price cassette can therefore be attached to a flat surface by means of the mounting webs, so that the mounting elements do not come into contact with this surface. If these mounting elements are designed in the form of a mounting clamps, the price cassette can alternatively be simply clipped onto a round bar or similar device. But the mounting elements can also be designed in the form of a locator groove, by means of which the price cassette can be placed on post or similar device. As a result of the curvature of the price cassette, in addition to the advantages described above, it has become possible for the first time to integrate several independent mounting systems without causing interference with one another. The price cassette can thus be used universally, e.g. the same price cassette can be fastened to C-shaped mounting strips of shelves and on cross members in cheese and deli cases. By means of a suitable post which is engaged in the mounting elements, the price cassettes can also be mounted directly, e.g. on merchandise pallets. The price displays in the market in question then have a uniform and consistent appearance.

BRIEF DESCRIPTION OF THE DRAWINGS

Additional advantages are indicated in the following description of one particularly preferred embodiment of the invention, which is illustrated in the accompanying drawings.

DESCRIPTION OF THE PREFERRED EMBODIMENT

Figure 1:
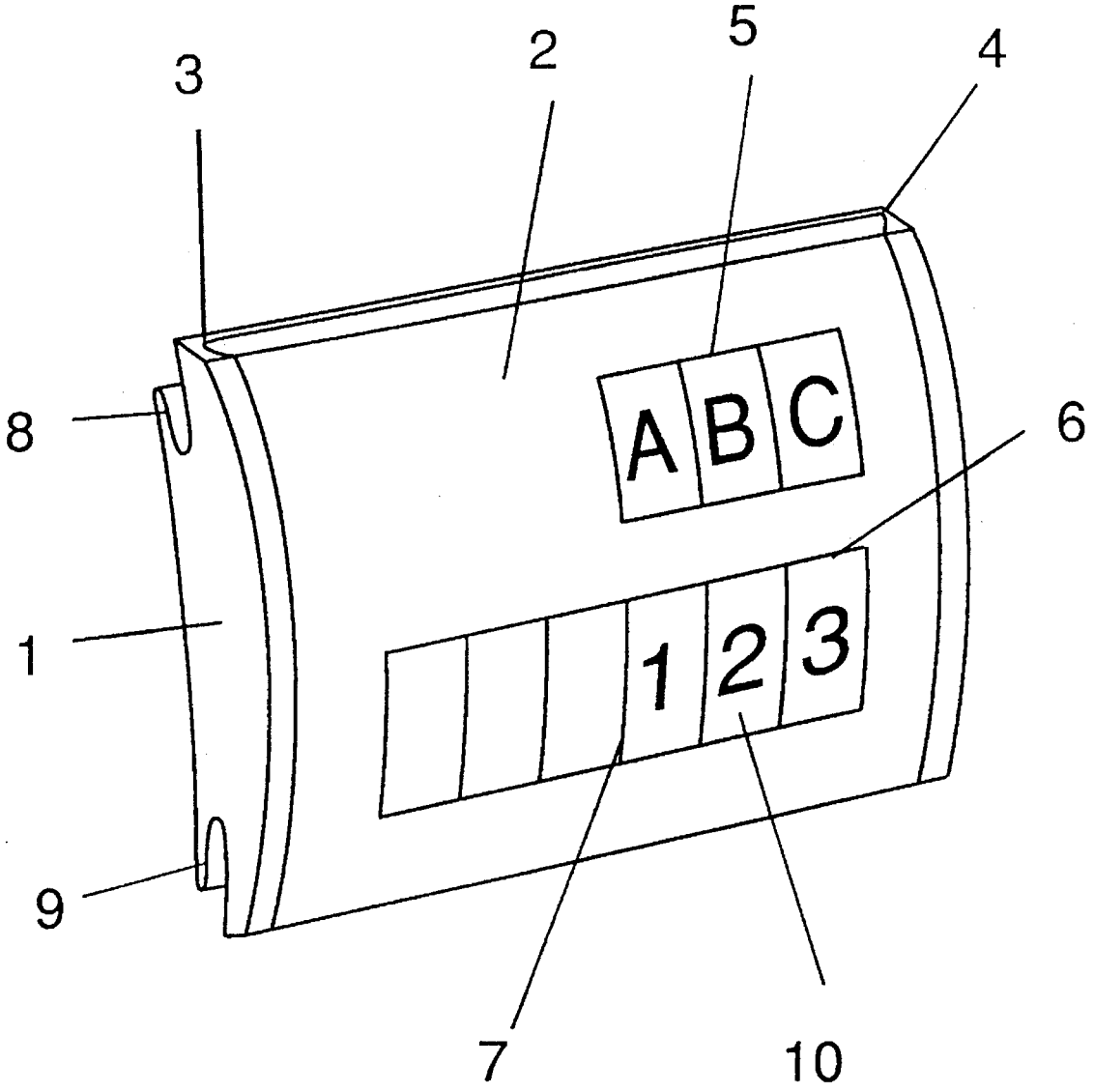
FIG. 1 is a view in perspective of a price cassette according to the invention.

FIG. 1 is a perspective view of a price cassette which has a back part 1 and a front part 2. The back part 1 has undercut guides 3 and 4, in which the front part 2 is held so that it can be pushed up and down. The back part and the front part are curved around an imaginary horizontal axis which lies behind the price cassette. There are windows 5 and 6 in the front part. When the front part 2 is completely transparent, these windows 5 and 6 can be created simply by inserting a cover film which is cut out in the area of the windows 5 and 6 behind the top part 2. A merchandise identification sign, which is symbolized by the letters "ABC", can be inserted behind the windows 5. In the window 6, separating webs 7 are visible which divide the space behind them into vertical panes 10. In each of these panes 10 there is an accordion-fold price sign, the bottom half of which can be read through the window. This accordion-fold price sign is symbolized by the numbers "123" in the last three panes 10.

FIG. 1 also shows that on the reverse-side corners of the price cassette, there are mounting webs 8 and 9 which are shaped so that the price cassette can be inserted into a C-shaped mounting rail.

Figure 2:
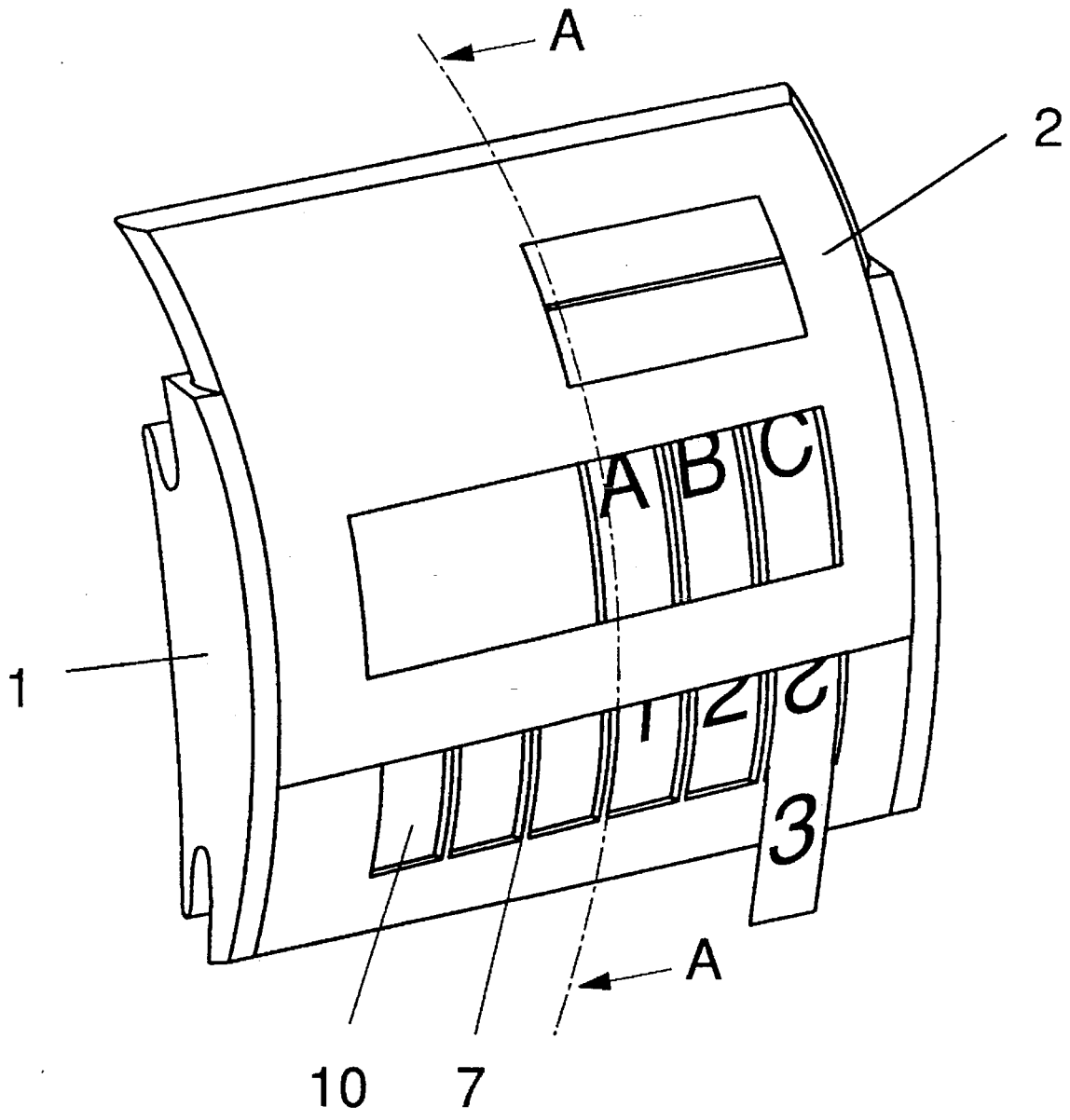
FIG. 2 is a view of the price cassette illustrated in FIG. 1 with the front part pushed halfway up.

FIG. 2 shows the price cassette illustrated in FIG. 1, with the front part 2 pushed halfway up. The item identification sign "ABC" thus moves behind the window 6. At the same time, the vertical panes 10 and the webs 7 separating them remain exposed. The price signs, as shown on the price sign farthest to the right in the figure, can now also be pulled out and the information to be displayed can be reinserted. In the same manner, the item identification sign "ABC" can be changed, if the front part 2 is pushed down.

Figure 3:
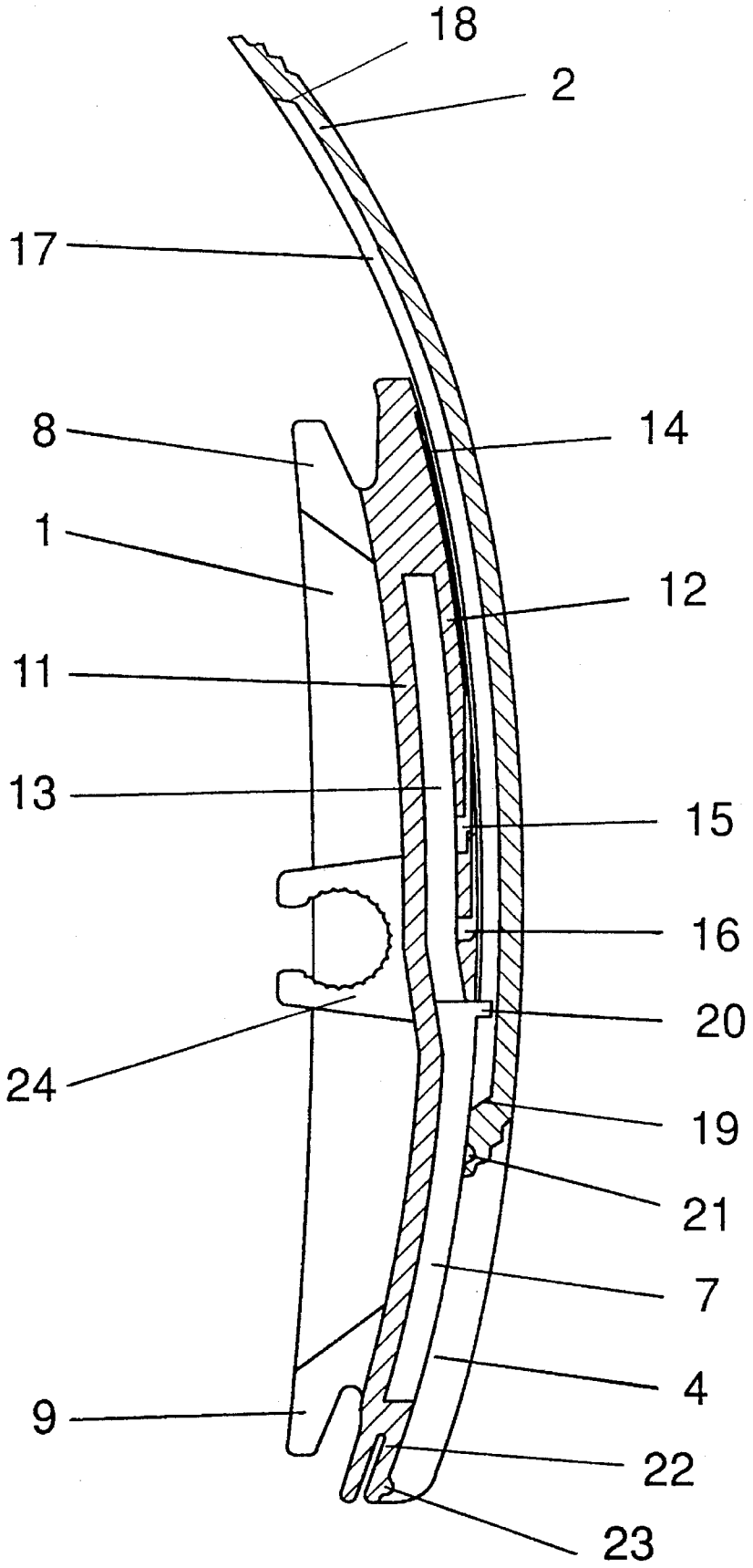
FIG. 3 is a cross section through the price cassette along Line A—A in FIG. 2.

Additional details are shown in FIG. 3, which is a cross section through the price cassette illustrated in FIG. 2 along line A—A. In the figures, identical parts are identified with the same reference numbers.

The back part 1 of the price cassette has a rear wall 11 curved in the shape of a circular arc, on which there are webs 7 in the lower half. In the upper half, at some distance from the rear wall 11, there is also a partition 12 which is curved in a circular fashion, whereby a space 13 is formed above the webs 7. To enlarge the space 13, the rear wall 11 is offset slightly toward the rear in the vicinity of the partition 12. The space 13 is open toward the webs 7 so that price signs can be inserted from below between the webs 7 into the space 13. On the front side of the partition 12, there is a pocket 14 in the form of a depression, which is used to hold an item identification sign.

There are slots 15 and 16 in the back part of the partition 12. The item sign can be inserted into one of these slots 15 and 16 and fixed by means of its lower edge. It is therefore possible to use items signs of different sizes.

In front of the webs 7 and the partition 12, i.e. to the right in the figure, there is a guide 4 for the top part 2. The partition 12, the webs 7 and the guide 4 are curved in the shape of a circular arc. The axis of curvature thereby lies far behind the price cassette, i.e. to the left in the figure.

The front part 2 is slid into the guide 4 from above. On its rear side, the top part 2 has an indentation 17 which is limited near the top end by an inclined step 18 and near the bottom end by an inclined step 19. By means of this indentation 17, additional space is created for the price and item signs to be inserted. An aperture plate can also be inserted into this indentation 17. From the upper ends of the webs 7 a raised portion 20 extends into the indentation 17. The raised portion 20 interacts with the steps 18 or 19, acting as a stop when the front part 2 is slid on, so that the front part 2 cannot be accidentally pushed all the way off. Below the indentation 17, on the reverse side of the front part 2, there is an additional recess 21. This recess 21 interacts with a projection 23 of a flexible tab in the closed position of the front part 2 so that the price cassette is then locked.

On the reverse side, i.e. to the left in the drawing, there are mounting elements 8 and 9, by means of which the price cassette can be inserted, for example, into a C-shaped rail which is fastened to the edge of a shelf. Between the mounting elements, in the middle of the price cassette, there is an additional mounting clamp 24, by means of which the price cassette, as an alternative to the fastening on the mounting elements 8 and 9, can be alternatively clipped onto a horizontal rod. It is also conceivable that a post can be used for the exposed mounting of the price cassette, in which case the price cassette can also be clipped to the post by means of the mounting clamp 24.

With the price cassette according to the invention, the following process is performed to change the price and/or item sign: In the position shown in FIGS. 2 and 3, the front part 2 is pushed up and away from the bottom part 1. The front part 2 can only be pushed upward until the step 19 encounters the raised portion 20. A complete removal of the top part 2 is thereby effectively prevented. In the illustrated position, the panes 10 between the webs 7 are accessible. The price signs located therein are pushed out forward as a result of the curvature on their lower edge, and can be pulled out downward, as shown in FIG. 2. The price signs are then rotated in the desired direction, and refolded as necessary until the desired information on their lower half is visible from the front. In this position, the price sign is inserted from below into the pane behind the top part. The top half of the price sign is thereby moved into the space 13. As a result of the curvature of the space 13 and the elasticity of the price signs, the latter are slightly clamped in place, and are thus prevented from falling out. After all the price signs have been moved into the desired position, the front part 2 can be locked into the projection 23 of the flexible tab 22 and the price cassette can be closed. The price signs, on account of their elasticity, are thereby in clean contact with the reverse side of the front part 2. During this operation, the item sign remains undisturbed in its fixed position in the top half of the price cassette.

To change the item sign, the front part 2 is slid off downward. The front part 2 can be pushed only as far as a position in which the step 18 encounters the raised portion 20. The item sign which is lying on the partition 12 is then freely accessible and can be removed. A new item sign can be inserted from above with its base in one of the slots 15 or 16, depending on the size of the sign, and can be fixed in place and correctly oriented. An even larger item sign can simply be placed with its base on the raised portion 20. Then the front part 2 is pushed back up until the projection 23 is locked into the recess 20, and the price cassette is closed. The item sign is then cleanly in contact with the reverse side of the top part.

When the price cassette is closed, all the price and item signs inserted are therefore in clean contact against the curved reverse side of the top part, so that the information is displayed on a surface which is curved evenly and uniformly. As a result of the curvature, the presentation also has a particularly plastic appearance. The appearance is not adversely affected by price and item signs which are pushed too far forward or back.

What is claimed is:

1. A price cassette for being fastened to an edge of a shelf, said cassette comprising:

a back part;

said back part having a plurality of panes disposed substantially adjacent to one another;

said panes being separated by webs disposed between said panes;

said webs having an elongated dimension and a substantially smaller dimension;

said webs being vertically disposed to orient said elongated dimension upon the fastening of said price cassette to a shelf;

information containing means said webs being configured to hold therebetween said information containing means;

said information containing means comprising at least one of:

a) interchangeable item identification information; and b) interchangeable item pricing information;

a front part disposed in front of said back part;

said back part having guides for receiving and guiding movement of said front part;

said guides comprising means for permitting the front part to slide with respect to said back part;

said back part comprising means for fastening said price cassette to a shelf;

said means for fastening to a shelf being disposed to directionally orient said price cassette so that said elongated dimension of said webs is disposed vertically when said back part is attached to a shelf;

said means for fastening comprising means for rigidly and substantially inflexibly mounting said price cassette on a solid elongated member on the front edge of a shelf;

said means for permitting said front part to slide with respect to said back part having a surface to permit said front part to slide substantially in an upward and downward direction with respect to said back part when said price cassette is fastened to a shelf;

said means for permitting said front part to slide with respect to said back part comprising means for allowing a substantial portion of said front part to move beyond said back part such that said substantial portion of said front part does not overlap said back part;

said means for permitting said upward and downward movement providing means for permitting said price cassette to be mounted on a shelf immediately beside another similar price cassette;

said front part having an open position and a closed position;

said open position of said front part exposing said panes and said information containing means;

said closed position of said front part covering said panes and said information containing means;

said surfaces of said guides having portions disposed substantially in the same directional orientation as said elongated dimension of said vertical webs;

said front part having at least one transparent portion; and said at least one transparent portion being disposed in said closed position to permit viewing of said information containing means disposed between said webs.

2. The price cassette according to claim 1, including stop means for preventing said front part from being completely pushed off of said back part.

3. The price cassette according to claim 2, wherein said stop means are disposed on one of:

a) said back part; and b) said front part.

4. The price cassette according to claim 3, wherein when said back part is attached to a shelf, said back part comprises a top oriented portion, a bottom oriented portion, and a middle oriented portion;

said stop means being disposed in said middle oriented portion, for preventing said front part from being pushed up or down more than about one-half way with respect to said back part.

5. The price cassette according to claim 4, wherein said stop means are disposed on, and comprise, a raised portion of said webs;

said front part having step portions being engagable with said stop means upon said front part being raised or lowered halfway up or halfway down with respect to said back part;

said step portions and said stop means facing one another; and said step portions facing said back part.

6. The price cassette according to claim 5, wherein said raised portions of said webs have a side which projects substantially perpendicular from said back part;

said step portions on said front part are inclined with respect to an extensive inner surface of said front part.

7. The price cassette according to claim 6, wherein said front part comprises a bottom edge and a top edge;

said step portions being disposed on said bottom edge and said top edge of front part;

said bottom edge having a middle portion disposed away from said guides;

said top edge having a middle portion disposed away from said guides;

said step portion on said top edge being disposed on said middle portion of said front part;

said step portion on said bottom edge being disposed on said middle portion of said front part.

8. The price cassette according to claim 7, wherein said back part comprises at least one flexible tab;

said front part comprises at least one recess;

said at least one flexible tab being disposed in said at least one recess upon said price cassette being in said closed position.

9. The price cassette according to claim 8, wherein said top oriented portion of said back part comprises a partition;

said back part having a frontwardly disposed portion and a rearwardly disposed portion;

said rearwardly disposed portion being disposed towards a shelf upon the fastening of said price cassette to a shelf;

said frontwardly disposed portion comprising a partition;

said partition comprising means for receiving said information containing means.

10. The price cassette according to claim 9, wherein said partition comprises means for fixing said information containing means in place;

said fixing means comprising slots.

11. The price cassette according to claim 10, wherein when said price cassette is mounted on a shelf having a longitudinal axis, said front part is curved around the longitudinal axis of the shelf;

said longitudinal axis of the shelf being oriented horizontally with relation to said information containing means.

12. The price cassette according to claim 11, wherein said panes and said partition are curved with relation to the curve of said front part.

13. The price cassette according to claim 12, wherein said at least one transparent portion is curved with relation to the cured of said front part.

14. The price cassette according to claim 13, wherein said means for fastening is disposed on said rearwardly disposed portion of said back part.

15. The price cassette according to claim 14, wherein said means for fastening comprises mounting webs which project from said rearwardly disposed portion;

said mounting webs comprising means for being inserted into a c-shaped mounting rail.

16. The price cassette according to claim 15, wherein a mounting clamp is disposed between said mounting webs;

said mounting clamp comprising means for clamping said price cassette to a rod;

said mounting clamp projecting substantially no further rearwardly from said back part than said mounting webs project rearwardly from said back part.

17. The price cassette according to claim 16, wherein said mounting clamp comprises a mounting groove disposed between said mounting webs; and by means of said mounting groove, said price cassette can be disposed on a post.

18. A price cassette for being fastened to the edge of a shelf, said cassette comprising:

a back part;

said back part having a plurality of panes disposed substantially adjacent to one another;

said panes being separated by webs disposed between said panes;

said webs having an elongated dimension and a substantially smaller dimension;

said webs being vertically disposed to orient said elongated dimension upon the fastening of said price cassette to a shelf;

said webs being configured to hold therebetween information containing means;

said information containing means comprising at least one of:

a) interchangeable item identification information; and b) interchangeable item pricing information;

a front part disposed in front of said back part;

an extreme front exterior surface and an extreme back exterior surface;

said extreme front exterior surface being disposed on said price cassette opposite and away from said extreme back exterior surface;

said extreme front exterior surface defining an outermost front surface of said price cassette;

said extreme back exterior surface defining an outermost back surface of said price cassette;

said extreme back exterior surface being disposed on said back part;

a substantial portion of said extreme front exterior surface being disposed on said front part;

said back part having guides for receiving and guiding movement of said front part;

said guides comprising means for permitting the front part to slide with respect to said back part;

said back part comprising means for fastening said price cassette to a shelf;

said means for fastening for being disposed towards a shelf;

said means for fastening being disposed on said extreme back exterior surface;

said means for fastening being disposed to orient said price cassette so that said elongated dimension of said webs is disposed vertically when said back part is attached to a shelf;

said means for permitting said front part to slide with respect to said back part having a surface to permit said front part to slide substantially in an upward and downward direction with respect to said back part when said price cassette is fastened to a shelf;

said means for permitting said front part to slide with respect to said back part comprising means for allowing a substantial portion of said front part to move beyond said back part such that said substantial portion of said front part does not overlap said back part;

said means for permitting said upward and downward movement providing means for permitting said price cassette to be mounted on a shelf immediately beside another similar price cassette;

said front part having an open position and a closed position;

said open position of said front part exposing said panes and said information containing means;

said closed position of said front part covering said panes and said information containing means;

said surfaces of said guides having portions disposed substantially in the same directional orientation as said elongated dimension of said vertical webs;

said front part having at least one transparent portion; and said at least one transparent portion being disposed in said closed position to permit viewing of said information containing means disposed between said webs.

19. The price cassette according to claim 18:

wherein said cassette further comprises stop means for preventing said front part from being completely pushed off of said back part;

wherein said stop means are disposed on one of:

a) said back part; and b) said front part;

wherein when said back part is attached to a shelf, said back part comprises a top oriented portion, a bottom oriented portion, and a middle oriented portion;

said stop means being disposed in said middle oriented portion, for preventing said front part from being pushed up or down more than about one-half way with respect to said back part;

wherein said stop means are disposed on, and comprise, a raised portion of said webs;

said front part having step portions being engagable with said stop means upon said front part being raised or lowered halfway up or halfway down with respect to said back part;

said step portions and said stop means facing one another;

said step portions facing said back part;

wherein said raised portions of said webs have a side which projects substantially perpendicular from said back part;

said step portions on said front part are inclined with respect to an extensive inner surface of said front part;

wherein said front part comprises a bottom edge and a top edge;

said step portions being disposed on said bottom edge and said top edge of front part;

said bottom edge having a middle portion disposed away from said guides;

said top edge having a middle portion disposed away from said guides;

said step portion on said top edge being disposed on said middle portion of said front part;

said step portion on said bottom edge being disposed on said middle portion of said front part;

wherein said back part comprises at least one flexible tab;

said front part comprises at least one recess;

said at least one flexible tab being disposed in said at least one recess upon said price cassette being in said closed position;

wherein said top oriented portion of said back part comprises a partition;

said back part having a frontwardly disposed portion and a rearwardly disposed portion;

said rearwardly disposed portion being disposed towards a shelf upon the fastening of said price cassette to a shelf;

said frontwardly disposed portion comprising a partition;

said partition comprising means for receiving said information containing means;

wherein said partition comprises means for fixing said information containing means in place;

said fixing means comprising slots;

wherein when said price cassette is mounted on a shelf having a longitudinal axis, said front part is curved around the longitudinal axis of the shelf;

said longitudinal axis of the shelf being oriented horizontally with relation to said information containing means;

wherein said panes and said partition are curved with relation to the curve of said front part;

wherein said at least one transparent portion is curved with relation to the curve of said front part;

wherein said means for fastening is disposed on said rearwardly disposed portion of said back part;

wherein said means for fastening comprises mounting webs which project from said rearwardly disposed portion;

said mounting webs comprising means for being inserted into a c-shaped mounting rail;

wherein a mounting clamp is disposed between said mounting webs;

said mounting clamp comprising means for clamping said price cassette to a rod;

said mounting clamp projecting substantially no further rearwardly from said back part than said mounting webs project rearwardly from said back part;

wherein said mounting clamp comprises a mounting groove disposed between said mounting webs; and by means of said mounting groove, said price cassette can be disposed on a post.

20. A price cassette for being fastened to the edge of a shelf, said cassette comprising:

a back part;

said back part having a plurality of panes disposed substantially adjacent to one another;

said panes being separated by webs disposed between said panes;

said webs having an elongated dimension and a substantially smaller dimension;

said webs being vertically disposed to orient said elongated dimension upon the fastening of said price cassette to a shelf;

said webs being configured to hold therebetween information containing means;

said information containing means comprising at least one of:

a) interchangeable item identification information; and b) interchangeable item pricing information;

a front part disposed in front of said back part;

said back part having guides for receiving and guiding movement of said front part;

said guides comprising means for permitting the front part to slide with respect to said back part;

said back part comprising means for fastening said price cassette to a shelf;

said means for fastening being disposed to orient said price cassette so that said elongated dimension of said webs is disposed vertically when said back part is attached to a shelf;

said means for permitting said front part to slide with respect to said back part having a surface to permit said front part to slide substantially up and down with respect to said back part upon mounting on a shelf;

said means for permitting said front part to slide with respect to said back part comprising means for allowing a substantial portion of said front part to move up with respect to said back part and beyond said back part such that said substantial portion of said front part does not overlap said back part;

said means for permitting said front part to slide with respect to said back part further comprising means for allowing an additional substantial portion of said front part to move down with respect to said back part and beyond said back part such that said additional substantial portion of said front part does not overlap said back part;

said means for permitting said upward and downward movement providing means for permitting said price cassette to be mounted on a shelf immediately beside another similar price cassette;

said front part having an open position and a closed position;

said open position of said front part exposing said panes and said information containing means;

said closed position of said front part covering said panes and said information containing means;

said surfaces of said guides having portions disposed substantially in the same directional orientation as said elongated dimension of said vertical webs;

said front part having at least one transparent portion; and said at least one transparent portion being disposed in said closed position to permit viewing of said information containing means disposed between said webs.

21. The price cassette according to claim 20:

wherein said cassette further comprises stop means for preventing said front part from being completely pushed off of said back part;

wherein said stop means are disposed on one of:

a) said back part; and b) said front part;

wherein when said back part is attached to a shelf, said back part comprises a top oriented portion, a bottom oriented portion, and a middle oriented portion;

said stop means being disposed in said middle oriented portion, for preventing said front part from being pushed up or down more than about one-half way with respect to said back part;

wherein said stop means are disposed on, and comprise, a raised portion of said webs;

said front part having step portions being engagable with said stop means upon said front part being raised or lowered halfway up or halfway down with respect to said back part;

said step portions and said stop means facing one another;

said step portions facing said back part;

wherein said raised portions of said webs have a side which projects substantially perpendicular from said back part;

said step portions on said front part are inclined with respect to an extensive inner surface of said front part;

wherein said front part comprises a bottom edge and a top edge;

said step portions being disposed on said bottom edge and said top edge of front part;

said bottom edge having a middle portion disposed away from said guides;

said top edge having a middle portion disposed away from said guides;

said step portion on said top edge being disposed on said middle portion of said front part;

said step portion on said bottom edge being disposed on said middle portion of said front part;

wherein said back part comprises at least one flexible tab;

said front part comprises at least one recess;

said at least one flexible tab being disposed in said at least one recess upon said price cassette being in said closed position;

wherein said top oriented portion of said back part comprises a partition;

said back part having a frontwardly disposed portion and a rearwardly disposed portion;

said rearwardly disposed portion being disposed towards a shelf upon the fastening of said price cassette to a shelf;

said frontwardly disposed portion comprising a partition;

said partition comprising means for receiving said information containing means;

wherein said partition comprises means for fixing said information containing means in place;

said fixing means comprising slots;

wherein when said price cassette is mounted on a shelf having a longitudinal axis, said front part is curved around the longitudinal axis of the shelf;

said longitudinal axis of the shelf being oriented horizontally with relation to said information containing means;

wherein said panes and said partition are curved with relation to the curve of said front part;

wherein said at least one transparent portion is curved with relation to the curve of said front part;

wherein said means for fastening is disposed on said rearwardly disposed portion of said back part;

wherein said means for fastening comprises mounting webs which project from said rearwardly disposed portion;

said mounting webs comprising means for being inserted into a c-shaped mounting rail;

wherein a mounting clamp is disposed between said mounting webs;

said mounting clamp comprising means for clamping said price cassette to a rod;

said mounting clamp projecting substantially no further rearwardly from said back part than said mounting webs project rearwardly from said back part;

wherein said mounting clamp comprises a mounting groove disposed between said mounting webs; and by means of said mounting groove, said price cassette can be disposed on a post.

* * * * *

UNITED STATES PATENT AND TRADEMARK OFFICE

CERTIFICATE OF CORRECTION

PATENT NO. : 5,564,210

DATED : October 15, 1996

INVENTOR(S) : Norbert HETZER and Antonio CHAMORRO BARRERA

It is certified that error appears in the above-indentified patent and that said Letters Patent is hereby corrected as shown below:

On the title page, item [56], under the "FOREIGN PATENT DOCUMENTS" section, after the '2096377' reference insert the following reference:

--WO9220056 11/1992 PCT Int'l Appl.--.

Signed and Sealed this

Twenty-fifth Day of February, 1997

*Attest:*

Bruce Lehman

BRUCE LEHMAN

*Attesting Officer*

*Commissioner of Patents and Trademarks*